US011685166B2

(12) United States Patent
Terada

(10) Patent No.: US 11,685,166 B2
(45) Date of Patent: Jun. 27, 2023

(54) LIQUID RESIDUAL-AMOUNT DETECTING DEVICE

(71) Applicant: CANON KABUSHIKI KAISHA, Tokyo (JP)

(72) Inventor: Junji Terada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/483,417

(22) Filed: Sep. 23, 2021

(65) Prior Publication Data

US 2022/0097398 A1 Mar. 31, 2022

(30) Foreign Application Priority Data

Sep. 30, 2020 (JP) ..... 2020-165956

(51) Int. Cl.
*B41J 2/175* (2006.01)

(52) U.S. Cl.
CPC .. *B41J 2/17566* (2013.01); *B41J 2002/17573* (2013.01); *B41J 2002/17576* (2013.01)

(58) Field of Classification Search
CPC ..... B41J 2/17566; B41J 2002/17573; B41J 2002/17576
See application file for complete search history.

(56) References Cited

U.S. PATENT DOCUMENTS

2011/0234717 A1* 9/2011 Sakurai ..... B41J 2/17566 347/86
2013/0162732 A1 6/2013 Takagi et al. ..... B41J 2/17503

FOREIGN PATENT DOCUMENTS

JP 6003054 B2 10/2016

* cited by examiner

*Primary Examiner* — Sharon Polk
(74) *Attorney, Agent, or Firm* — Venable LLP

(57) ABSTRACT

A liquid residual-amount detecting device includes an optical sensor having a pair of a light emitting portion and a light receiving portion; and a plurality of liquid cartridges, each having a containing portion, a float disposed in the containing portion, and a light shielding portion displaced on a path that crosses an optical path of detection light in synchronization with displacement of the float, wherein the light shielding portions each having a size such that a light amount of the detection light, which the light receiving portion receives, cannot be made smaller than a predetermined light amount by alone; and wherein when the float is at a highest position, they are disposed to be aligned in a direction crossing the optical path so as to shield the optical path, and the light amount, which the light receiving portion receives, is made smaller than the predetermined light amount.

8 Claims, 8 Drawing Sheets

LIQUID RESIDUAL-AMOUNT DETECTING DEVICE

BACKGROUND OF THE INVENTION

Field of the Invention

The present invention relates to a liquid residual-amount detecting device included in an image recording apparatus that records images by ejecting a liquid to a recording material.

Description of the Related Art

An image recording apparatus (also called a liquid ejecting apparatus in some cases) which records an image by ejecting a liquid, as represented by ink, from a liquid ejecting head to a recording material, such as recording sheets and the like, is known. By means of ink droplets landed on the recording sheet, a desired image is recorded on the recording sheet. An ink cartridge (liquid cartridge) storing ink to be supplied to a recording head is provided in such an image recording apparatus. The ink cartridge is detachable with respect to the image recording apparatus, and when the ink in the ink cartridge is depleted, the ink cartridge is removed from the image recording apparatus, and a new ink cartridge is attached to the image recording apparatus. In order to determine such a replacement timing of an ink cartridge, means for detecting an ink residual amount in the ink cartridge has been proposed.

One example of liquid residual-amount detecting means is a method for detecting displacement of a storage amount of ink by using buoyancy of a float capable of rotational movement in a container of the ink cartridge. With the displacement serving as rotational movement of a connecting member, an attitude of a light shielding plate is changed, the attitude change of the light-shielding plate is optically detected, and the ink amount in an ink chamber is determined.

Japanese Patent No. 6003054 discloses an ink cartridge in which performance of conversion from the buoyancy to gravity is enhanced by forming a float having an inverted triangular shape and by making the rotational movement easier against surface tension resistance of the ink, detection accuracy of the ink amount is improved.

SUMMARY OF THE INVENTION

However, since vertical fluctuation of an ink liquid level, caused by vibration of the liquid ejecting device or the like, synchronizes with the light shielding plate, an error is generated in the ink residual-amount detection until the vertical fluctuation of the ink liquid level is stabilized.

An object of the present invention is to provide an art which can reduce errors in the ink residual-amount detection.

In order to solve the aforementioned problem, a liquid residual-amount detecting device for detecting a residual amount of the liquid contained in a liquid cartridge of the present invention includes:

an optical sensor having a pair of a light emitting portion and a light receiving portion; and a plurality of liquid cartridges, each having a containing portion that contains the liquid, a float disposed in the containing portion and receiving buoyancy of the liquid, and a light shielding portion displaced on a path that crosses an optical path of detection light emitted by the light emitting portion in synchronization with displacement of the float, wherein the light shielding portion is provided in plurality, with the light shielding portions each having a size such that a light amount of the detection light, which the light receiving portion receives, cannot be made smaller than a predetermined light amount by neither of the light shielding portions alone, and wherein when the float is at a highest position in each of the plurality of liquid cartridges, the plurality of light shielding portions are disposed to be aligned in a direction crossing the optical path and shield the optical path, and the light amount of the detection light, which the light receiving portion receives, is made smaller than the predetermined light amount.

According to the present invention, the detection error in the ink residual-amount can be reduced.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Inkjet Printer

Figure 7:
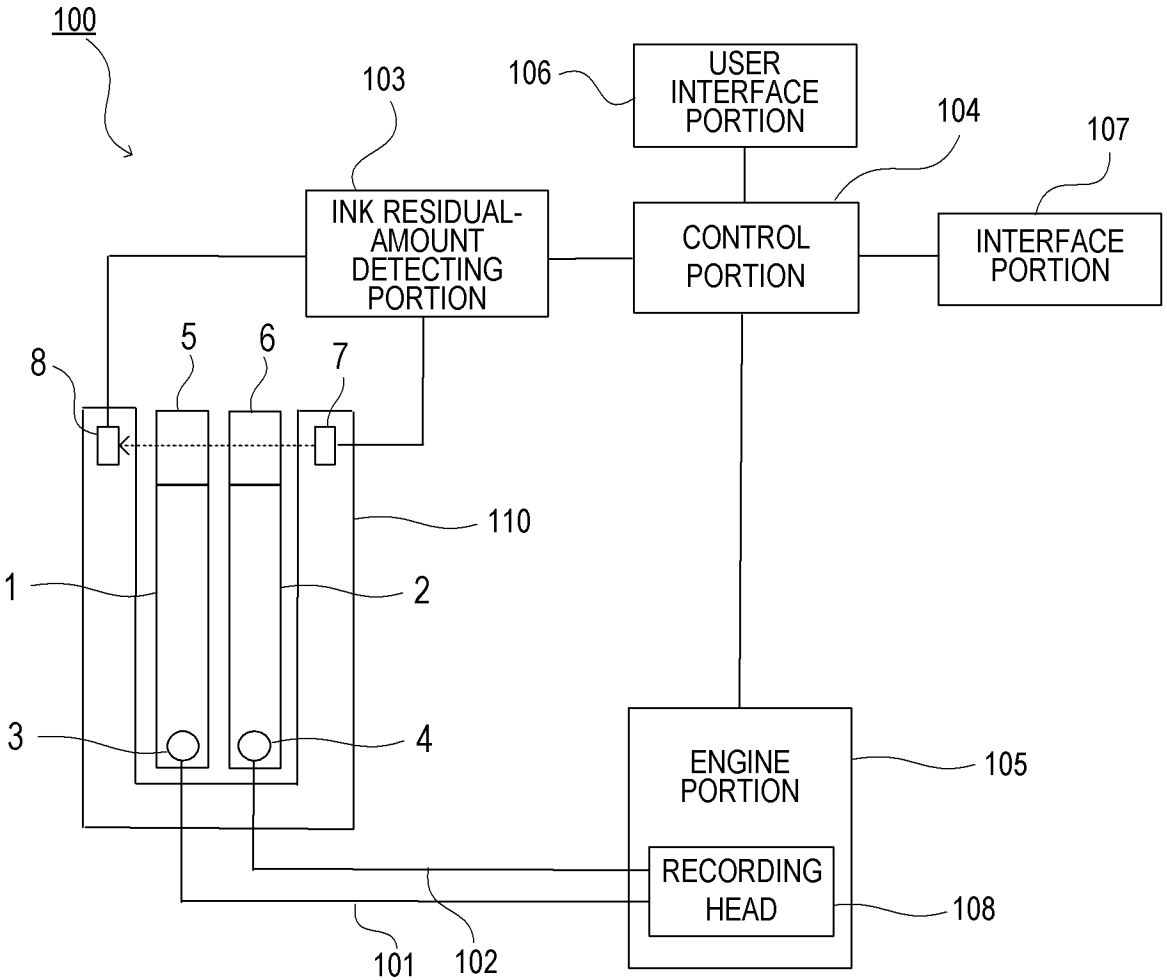
FIG. 7 is a schematic diagram of an ink residual-amount detecting device and an image recording apparatus according to Embodiment 1.

By referring to FIG. 7, schematic configuration of an ink residual-amount detecting device and an inkjet printer according to Embodiment 1 of the present invention will be described. In an ink supply device of the inkjet printer 100 (hereinafter referred to as a recording apparatus 100) which is an image recording apparatus (liquid ejecting apparatus), a cartridge attachment portion 110 is provided. A control portion (CPU) 104 executes control of the entire recording apparatus 100 including an ink residual-amount detecting portion 103. An engine portion 105 has a drive motor or the like having a recording head 108 to perform a recording operation and is operated by an instruction of the control portion 104. A user interface portion 106 has a display panel and an operation panel, not shown. An interface portion 107 receives recording data from an external host device.

The recording head 108 generates heat energy by supplying electric energy to an electricity-heat conversion element located inside the recording head 108 on the basis of the recording data sent from the external host device. Air bubbles are generated in the ink by the generated heat energy, and ink droplets are ejected by a pressure generated at generation of the air bubbles from each ejection port disposed on a surface facing a recording medium. The recording head 108 ejects the ink droplets while reciprocating with respect to the recording medium, and the recording medium is intermittently conveyed at each reciprocation of the recording head 108, whereby an image is recorded on the entire recording medium.

Ink tanks 1 and 2 as a plurality of ink storage portions are of a cartridge type which are detachably attached by a user and are attached to the cartridge attachment portion 110 by each color. In this Embodiment, only the ink tanks in two colors are shown, but the ink tanks in four colors, that is, black, cyan, magenta, and yellow may be constituted detachably, for example. Joint portions to which supply ports 3 and 4 of each of the ink tanks are connected are provided in the cartridge attachment portion 110, and the recording head 108 and the joint portions are connected by ink channels 101 and 102 formed by a flexible tube or the like. Note that a constitution for detecting an ink residual amount in the ink tank fixed to the recording apparatus 100 main body is exemplified as an example of the ink storage portion in this embodiment, but this is not limiting, and a form such as a sub tank or the like mounted on a carriage together with the recording head 108 may be employed.

When an empty state where the ink residual amount is less than a predetermined amount is detected by the residual-amount detection of the liquid residual-amount detecting device which will be described later, the control portion 104 notifies it to a user through the display panel of the user interface portion 106 and prompts check of the ink cartridge and replacement to a new ink cartridge.

Ink Cartridge

Figure 1:
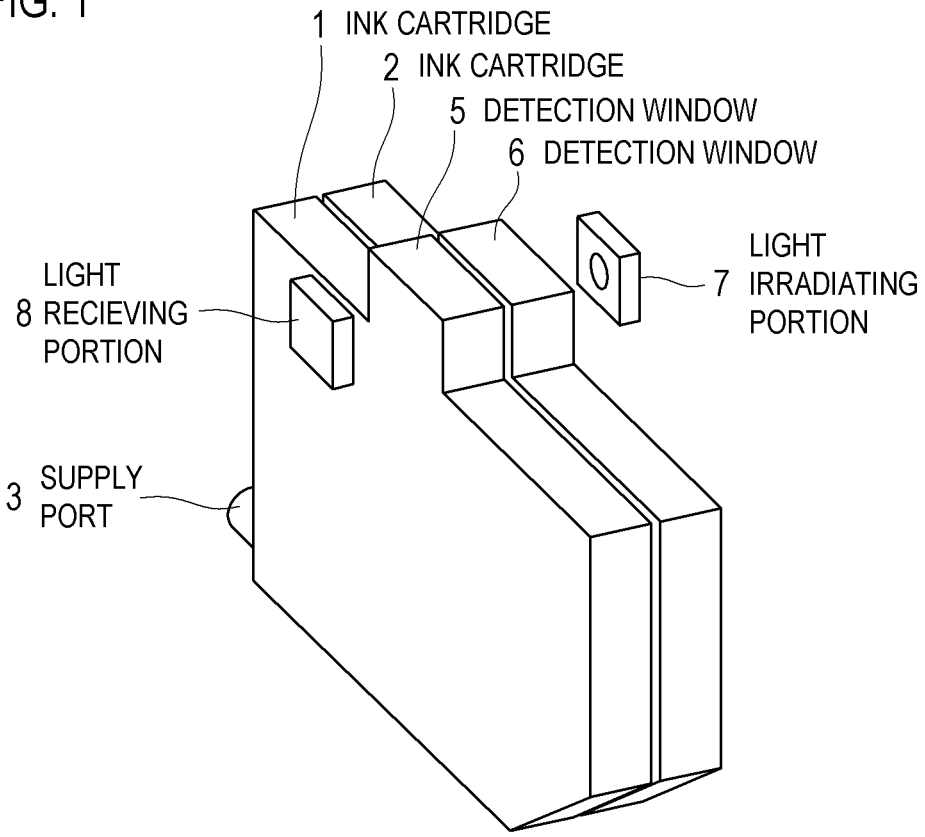
FIG. 1 is a schematic perspective view of a state where two ink cartridges are aligned in parallel.

By referring to FIGS. 1 and 2, the constitution of the ink cartridge as a liquid cartridge will be explained. In the cartridge attachment portion 110, the ink cartridges 1 and 2 which are containers storing the ink as the liquid can be attached. When the ink cartridges 1 and 2 are attached to the cartridge attachment portion 110, the ink can flow toward the apparatus main body side through the ink supply ports 3 and 4. On upper parts of the ink cartridges 1 and 2, detection windows 5 and 6 which optically detect the residual amounts of the ink and are made of a light transmitting synthetic resin which transmits infrared light, for example, protrude.

Ink Residual-Amount Detector

An ink residual-amount detector as the liquid residual-amount detecting device is constituted by an optical detecting portion which optically determines an ink residual amount by an attitude change of a light shielding plate and a residual-amount displacement detecting portion which recognizes displacement of the ink storage amount in the container of the ink cartridge by a rotatable float.

Optical Detecting Portion

By referring to FIGS. 1 and 2, a constitution and an operation of the optical detecting portion (optical sensor) will be explained. Adjacent to the ink cartridge 1, the ink cartridge 2 having an outer shape similar to that of the ink cartridge 1 and a different color is aligned in parallel in a predetermined direction, and a pair of light irradiating portion 7 and light receiving portion 8 are disposed by facing the detection windows 5 and 6 with the detection windows 5 and 6 of the both ink cartridges 1 and 2 sandwiched between. The light irradiating portion (light emitting portion) 7 is a light-emitting element such as an LED, and the light receiving portion 8 is made of a light-receiving element such as a phototransistor and a photodiode.

The containers of the ink cartridges 1 and 2 have light shielding plates 15 and 16 synchronizing with rotatable floats 9 and 10 which recognize displacement by the ink storage amount by arms 13 and 14 which are connecting members from support shafts 11 and 12 therein. The floats 9 and 10, the support shafts 11 and 12, and the arms 13 and 14 have the same shape, but the light shielding plates 15 and 16 which shield light beams from the light irradiating portion 7 toward the light receiving portion 8 form different shapes. Thus, the main constitution of the optical detecting portion includes the pair of light irradiating portion 7 and light receiving portion 8, the detection windows 5 and 6 of the two ink cartridges 1 and 2, and the light shielding plates 15 and 16 as the light shielding portions.

With respect to a rotation direction in which the floats 9 and 10 are displaced toward bottom surface sides of the ink cartridges 1 and 2 after the ink storage amount is reduced, the light shielding plate 15 has a light-shielding plate shape which shields the right half and the light shielding plate 16 has the shape which shields the left half toward the light irradiating portion 7 which equally divides the light beam in a vertical line direction. If the container of the ink cartridge is filled with the ink, since the light beam from the light irradiating portion 7 is shielded by the light shielding plates 15 and 16, the light beam is not received by the light receiving portion 8, and it is determined that an output is in an OFF state. When an attitude of the light shielding plate 15 or 16 is changed, and the light beam reaches the light receiving portion 8, it is determined that the output is in an ON state. That is, the light shielding plates 15 and 16 are displaced on a path crossing an optical path of the light beam as detection light in synchronization with the displacement of the floats 9 and 10 disposed in the ink containing portions of the ink cartridges 1 and 2.

Residual-Amount Displacement Detecting Portion

Figure 3:
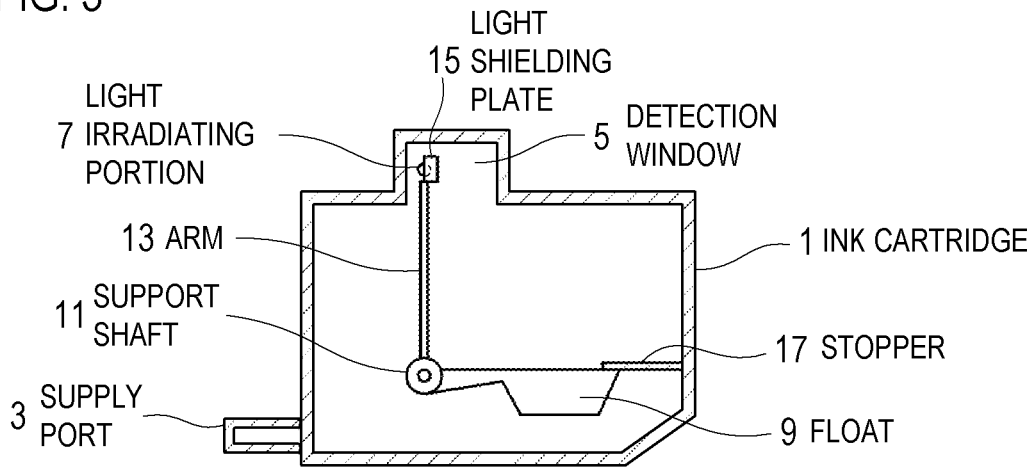
FIG. 3 is a schematic sectional view when an ink storage amount in the ink cartridge is full.
Figure 4:
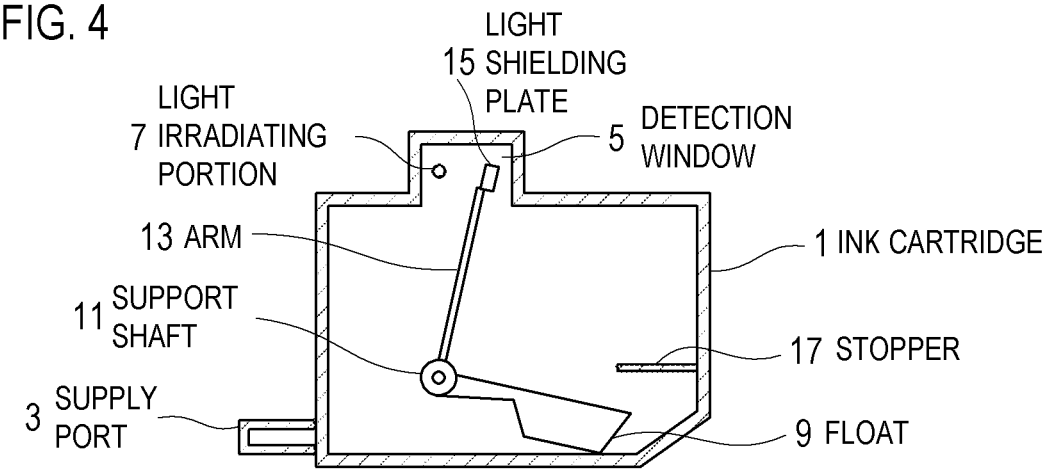
FIG. 4 is a schematic sectional view at residual-amount detection of the ink storage amount in the ink cartridge.

By referring to FIGS. 3 and 4, a constitution and an operation of the residual-amount displacement detecting portion will be explained. FIGS. 3 and 4 illustrate states of a case in which the ink storage amount in the container of the ink cartridge is full and a case in which the residual amount is being detected, respectively. FIG. 3 is a state where the ink cartridge 1 is attached to the cartridge attachment portion, and the ink can flow out to the apparatus main body side through the ink supply port 3. FIG. 4 is a state where the ink in the ink chamber becomes less than a predetermined amount, and timing for replacement to a new ink cartridge is recognized.

In FIG. 3, the main constitution of the residual-amount displacement detector portion includes the float 9, the support shaft 11, the arm 13 which is the connecting member, and a stopper 17. The float 9 is made of a sealed container made of a polyacetal resin, a polypropylene resin or the like, for example, which has a specific weight smaller than that of the ink. The float 9 is connected to the support shaft 11 and is connected to the light shielding plate 15 located in the detection window 5 by the arm 13 from the support shaft 11. When the ink is full, the buoyancy generated in the float 9 generates a rotational force which creates a left rotation toward the light beam from the light irradiating portion 7 in the light shielding plate 15 synchronized by the support shaft 11. However, the float 9 abuts against the stopper 17 provided in the container of the ink cartridge 1 so that a state where of being forcedly sunk in the ink is kept. Thus, until the ink level lowers below the float 9, the rotational force to the left rotation is generated, the float position is fixed by the stopper 17, and the light shielding plate 15 is held at a standing position which shields the light beam.

In FIG. 4, when the ink level lowers below the float 9, gravity overcomes the buoyancy in the float 9, and the rotational force forming a right rotation toward the light beam from the light irradiating portion 7 is generated in the light shielding plate 15 synchronized by the support shaft 11. When the ink level becomes less than the predetermined amount, the float 9 reaches a residual-amount recognition state close to a bottom surface of the ink cartridge 1. At this time, the light shielding plate 15 synchronizing with the float 9 by the support shaft 11 has the attitude changed to a right end portion of the detection window 5, avoiding a light beam region of the light irradiating portion 7, and allows the light beam to be received by the light receiving portion 8. In the float 9 in the residual-amount recognition state, the gravity overcomes the buoyancy, and a state close to the bottom surface of the ink cartridge 1 is kept stably even if the ink liquid level is vertically fluctuated by vibration of the apparatus or the like and thus, the light shielding plate 15 synchronized by the support shaft 11 is also held at the right end portion of the detection window 5.

Operation of Ink Residual-Amount Detector

FIGS. 5A to 5E show schematic diagrams of the attitude changes of the light shielding plates 15 and 16 in accordance with the ink storage amount when viewed from the light receiving portion 8 toward the light irradiating portion 7. The attitude changes of the light shielding plates 15 and 16 which detect whether the light receiving portion 8 can receive the light or not when the ink residual amounts of the two ink cartridges 1 and 2 are to be determined by the pair of light irradiating portion 7 and light receiving portion 8 will be explained.

Figure 5A:
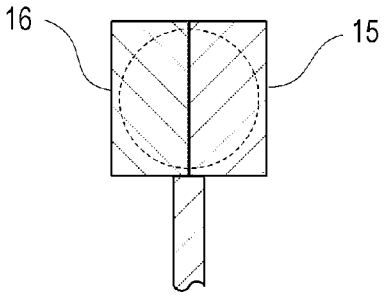
FIGS. 5A to 5E are schematic diagrams of the ink storage amounts and attitude changes of the light shielding plate when viewed toward the light irradiating portion 7.

In FIG. 5A, the light beam from the light irradiating portion 7 is shielded by the light shielding plates 15 and 16, and the light beam cannot reach the light receiving portion 8 located on a front side of the paper surface and thus, the light receiving portion 8 turns OFF the output, and it is determined to be an ink full state. Note that FIG. 5A is a state where the float 9 in FIG. 3 abuts against the stopper 17, and the light shielding plate 15 is held at the standing position where the light beam is shielded.

Figure 5D:
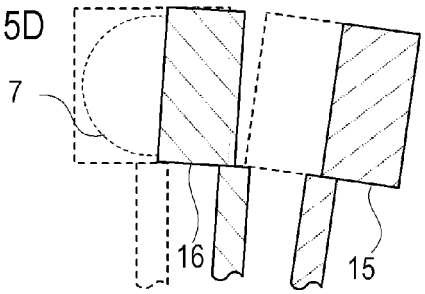
Figure 5B:
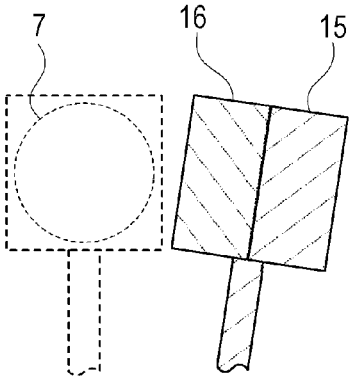

In FIG. 5B, the light shielding plates 15 and 16 have the attitudes changed to outside of the light beam region of the light irradiating portion 7, and the light beam can reach the light receiving portion 8 located on the front side of the paper surface and thus, the light receiving portion 8 turns ON the output, and it is determined that the ink is less than the predetermined amount. Note that, in FIG. 5B, the gravity overcomes the buoyancy of the float 9 in FIG. 4 and thus, the state where the float 9 is close to the bottom surface of the ink cartridge 1 is held even if the ink liquid level is vertically fluctuated by vibration of the apparatus or the like, and the light shielding plate 15 is in a state held at the right end portion of the detection window 5. The same applies to the light shielding plate 16. Since a signal of the output ON is displayed on the apparatus main body side, the ink cartridge is visually recognized, and the ink cartridge with no more ink is replaced with a new ink cartridge.

Figure 5E:
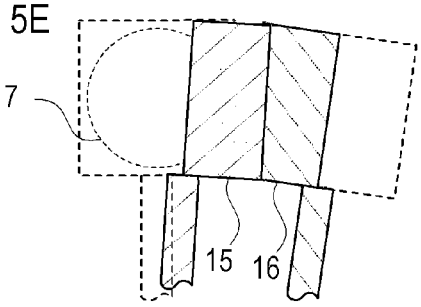
Figure 5C:
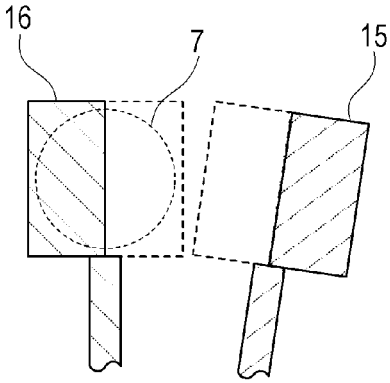

The light shielding plate 15 in FIG. 5C has finished the attitude change to the outside of the light beam region of the light irradiating portion 7, but the light shielding plate 16 shields the light beam. As a result, the light receiving portion 8 can receive a half of the light beam, that is, 50%. The light receiving portion 8 turns ON the output, and it is determined that the ink is less than the predetermined amount. Since the signal of the output ON is displayed on the apparatus main body side, the ink cartridge is visually recognized, and the ink cartridge with no more ink is replaced with a new ink cartridge.

In FIG. 5D, the light shielding plate 15 has finished the attitude change to the outside of the light beam region of the light irradiating portion 7, but the light shielding plate 16 has changed the attitude in the middle of the light beam region and the outside the light beam region. That is, the light shielding plate 16 is located at a transition state of the attitude change from the state where the float 9 abuts against the stopper 17 as referred to in FIG. 3 to the state close to the bottom surface of the ink cartridge 1 referred to in FIG. 4.

When the ink level begins to lower below an upper surface of the float 9, the ink storage amount is such that the buoyancy and the gravity are balanced, and the ink level is vertically fluctuated by the vibration of the apparatus or the like, the float is in a state of floating up and down. In FIG. 5D, when the ink level rises by the vibration, the buoyancy increases, and the light shielding plate 16 synchronized by the support shaft 11 changes the attitude to an inner side of the light beam region. Moreover, when the ink level lowers, the gravity increases, and the light shielding plate 16 synchronized by the support shaft 11 changes the attitude to the outside of the light beam region.

While the ink level is vertically fluctuated, and the light shielding plate 16 changes the attitude to inside and outside of the light beam region, the light receiving portion 8 can always receive at least 30% of the light beam as the predetermined light amount. That is because, the light shielding plate 16 in the present embodiment has such a size that the light receiving amount on the light receiving portion 8 is at least 30%, even if the light shielding plate is located at a center of the light beam, that is, when a light-beam diameter is shielded with the largest area. As a result, the light receiving portion 8 turns ON the output, and it is determined that the ink amount is less than the predetermined amount. Note that the same applies to the light shielding plate 15, and even in a state where the light-beam diameter is shielded the most, the size is set such that the light receiving amount on the light receiving portion 8 is at least 30%. As a rate of the predetermined light amount which is to be a standard on which whether the ink residual amount is less than the predetermined amount or not is determined in the determination on whether the ink cartridge needs to be replaced or not is not limited to 30% but is set as appropriate depending on the apparatus specification and the like.

Note that the shape of the light shielding plates 15 and 16 which obtains the light receiving amount of at least 30% needs to have such a condition that a width L of the light shielding plate which equally divides the substantially circular light beam is larger than a half of a light beam diameter Φ and smaller than the light beam diameter Φ. That is, the light shielding plates 15 and 16 have such a size that the light receiving amount cannot be made smaller than 30% by neither of these shielding plates alone. The sizes of the light shielding plates 15 and 16 are set such that, when the positions of the floats 9 and 10 are disposed so as to be the largest and aligned in a direction crossing the optical path of the light beam, they can shield the light so that the light receiving amount becomes less than 30%. More preferably, the width should be the smallest width with which a detection error caused by light beam leakage is not generated in the light receiving portion 8 in the ink full state in FIG. 5A. The detection errors caused by the light beam leakage include an adjustment error of a light beam axis when the light irradiating portion 7 and the light receiving portion 8 are installed, a positional error of the light shielding plate involved in an attachment position error when the cartridge of the ink cartridge is attached and the like.

In FIG. 5E, the light shielding plate 16 has finished the attitude change to the outside of the light beam region of the light irradiating portion 7, but the light shielding plate 15 has changed the attitude to the middle between the light beam region and the outside of the light beam region. The light shielding plate 15 is located in the transition state changing from the state where the float 9 in FIG. 3 abuts against the stopper 17 to the state close to the bottom surface of the ink cartridge 1 in FIG. 4. The light shielding plate 16 is in a state where the gravity overcomes the buoyancy in the float 9 referred to in FIG. 4, and even if the ink level is vertically fluctuated by the vibration of the apparatus or the like, the state where the float 9 is close to the bottom surface of the ink cartridge 1 is kept. As a result, the light shielding plate 16 holds the state where the attitude is changed to the right end portion of the detection window 6. Thus, the light receiving portion 8 can receive the light of at least 50%, which is a half of the light beam. The light receiving portion 8 turns ON the output, and it is determined that the ink is less than the predetermined amount.

Reduction in Determination Error of Optical Detecting Portion

Figure 6A:
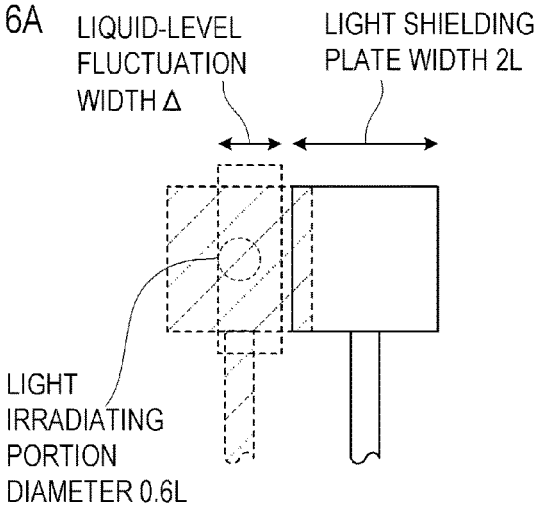
FIGS. 6A to 6F are schematic diagrams for explaining an error relationship between shapes of light irradiating portions and light shielding plates and the ink residual-amount detection.
Figure 6D:
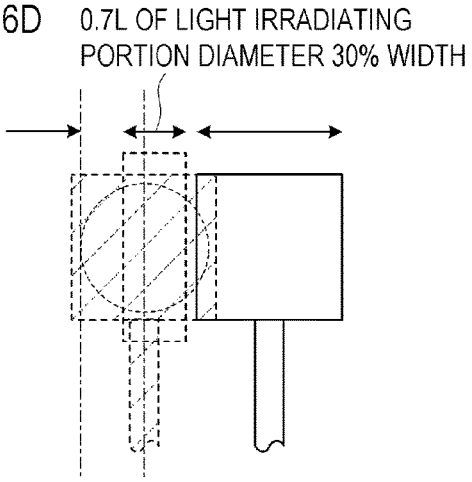
Figure 6B:
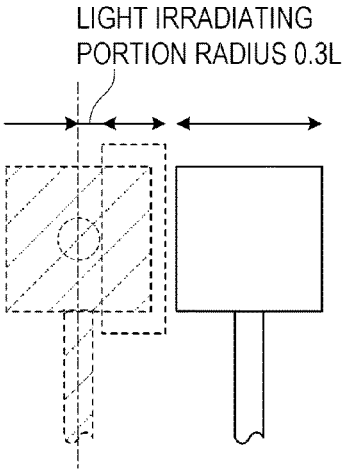
Figure 6E:
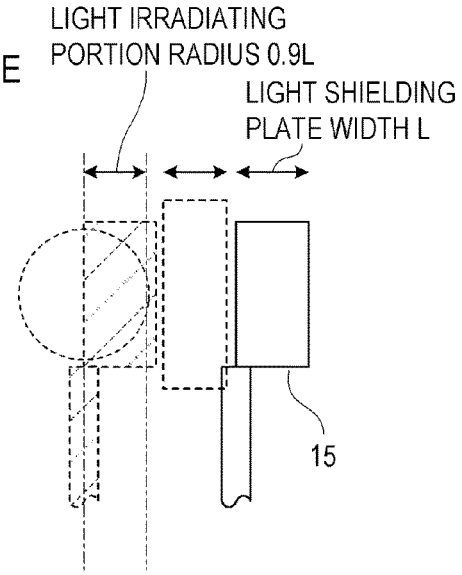
Figure 6C:
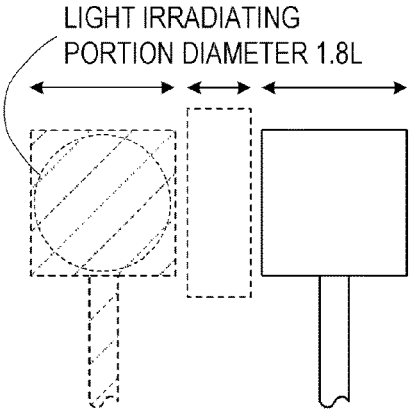
Figure 6F:
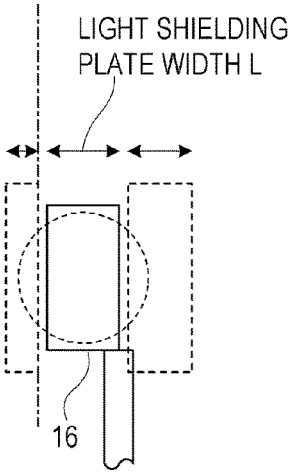

FIGS. 6A to 6F are schematic diagrams for explaining the attitude changes of the light plate when the shapes of the light irradiating portion and the light shielding plate are different, viewed from the light receiving portion 8 toward the light irradiating portion 7, respectively, and the determination errors of the optical detecting portion. In FIGS. 6A to 6D, a pair of the light irradiating portion and the light receiving portion are used for one ink cartridge, and FIGS. 6E and 6F are explanatory schematic diagrams in which the pair of light irradiating portion and light receiving portion are used for two ink cartridges.

In FIG. 6A, it is assumed that the diameter of the light irradiating portion is 0.6 L, the width of the light shielding plate is 2 L, and vertical fluctuation of the ink level is generated by A. The light shielding plate illustrated with shading indicates an initial standing position when the ink was full. A center of the light shielding plate and a center of the light irradiating portion match each other. A solid line indicates a transition state in the middle of the attitude change from the ink full to an ink residual-amount determination position. Moreover, the vertical fluctuation Δ of the ink level is indicated by a dotted-line rectangle. When the light shielding plate starts the attitude change in synchronization with the displacement of the float and begins to go out of the light beam region of the light irradiating portion 7, it receives the vertical fluctuation Δ of the ink level. The attitude change of the light shielding plate is illustrated by being moved to the side for simplification in the figure. As a result, such an error operation that the light shielding plate shields or transmits the light beam of the light irradiating portion occurs. That is, the light receiving portion located on the upper surface side with respect to the paper surface turns OFF and ON the output and thus, the determination error is generated in the optical detecting portion.

In order for the light receiving portion to obtain a stable output, the state needs to be such as in FIG. 6B in which the light shielding plate has changed the attitude to the right direction on the outer side of the light beam region of the light irradiating portion only by a portion of the vertical fluctuation Δ of the ink level to which L is added. That is, the light shielding plate needs to move from the initial light-shielding plate position which is the ink full state to the right by 1.3 L+Δ acquired by adding the length L to the center of the light irradiating portion, the radius 0.3 L of the light irradiating portion, and the liquid-level fluctuation Δ together.

In FIG. 6C, the diameter of the light irradiating portion is expanded from 0.6 L to 1.8 L, and the width of the light shielding plate and the vertical fluctuation of the ink level are similarly set to 2 L and Δ. The light shielding plate starts the attitude change in synchronization with the displacement of the float, the float keeps the state close to the bottom surface of the ink cartridge and is in a state not subjected to an influence of the vertical fluctuation Δ of the ink level anymore. That is, the attitude change of the light shielding plate required for the light receiving portion to stably switch the output from OFF to ON is 1.9 L+Δ acquired by adding L, which is a ½ width of L of the light shielding plate, the radius 0.9 L of the light irradiating portion, and the liquid level fluctuation Δ together.

FIG. 6D illustrates the attitude change position of the light shielding plate when switching of the output in the light receiving portion, that is, switching between ON and OFF is set to be performed at the light receiving amount of at least 30%. In order to receive the 30% light amount from the light irradiating portion with the diameter of 1.8 L, it is only necessary to move the light shielding plate from the left end of the light irradiating portion to the center side of the light beam only by 0.7 L. That is, in order for the light receiving portion to obtain the stable output with respect to the vertical fluctuation of the ink level, the light shielding plate needs to change the attitude by 0.8 L+Δ acquired by adding a distance 0.1 L from the left end of the initial light shielding plate to the light irradiating portion, the irradiation width 0.7 L of the light irradiating portion at which the light amount becomes at least 30%, and the width A of the liquid level fluctuation together.

Figure 2:
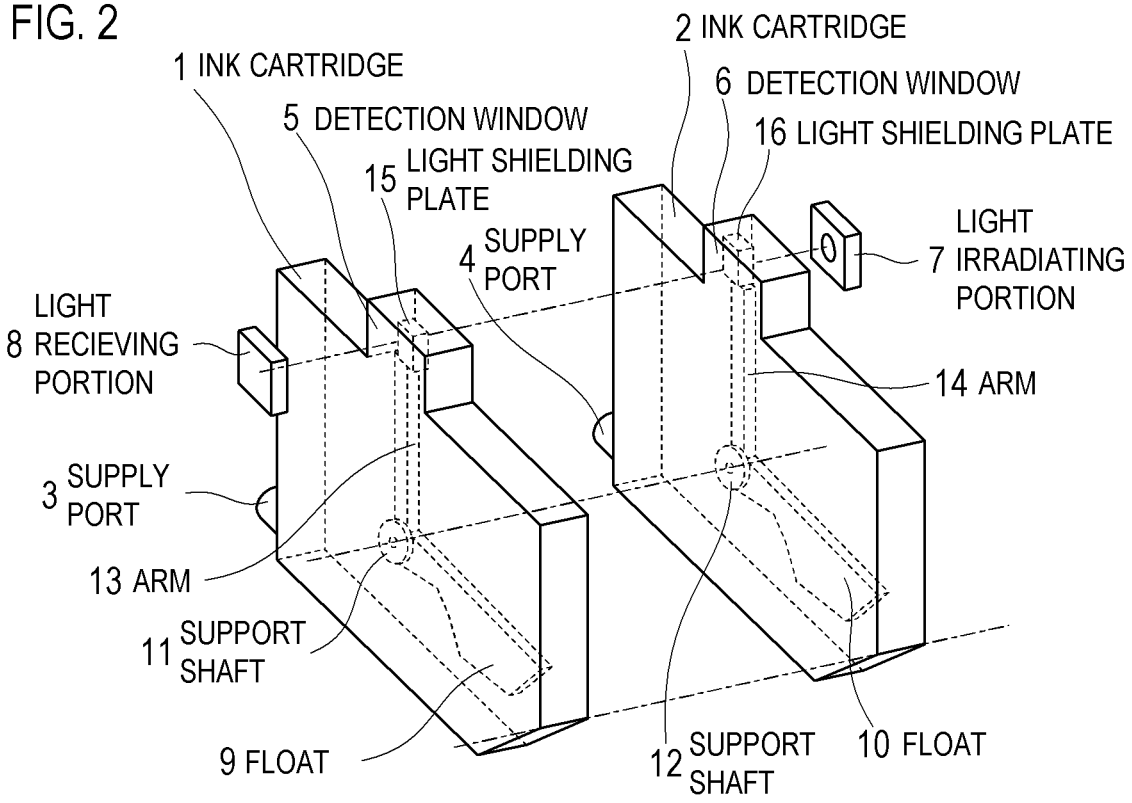
FIG. 2 is a schematic transparent perspective disposition view of the ink cartridges.

FIGS. 6E and 6F correspond to the light shielding plates 15 and 16 of the ink residual-amount detector illustrated in FIG. 2. FIG. 6E is a state where the attitude has changed such that the light shielding plate 15 is not subjected to the influence of the vertical fluctuation Δ of the ink liquid level from the diameter 1.8 L of the light irradiating portion anymore. That is, the attitude needs to be changed to the right only by 0.9 L+Δ acquired by adding the radius 0.9 L of the light irradiating portion and the fluctuation Δ of the ink liquid level together. When the light shielding plate 15 is in the state in FIG. 6E, since the light shielding plate 16 in FIG. 6F has a width of approximately a half of the diameter of the light irradiating portion 7, the light amount of at least 30% can be obtained at any position on the light beam from the light irradiating portion 7. Thus, the optical detecting portion is not subjected to the influence of an error of the ink liquid level.

The vertical fluctuation±A of the ink liquid level cannot be solved in the present invention, but by making the width of the light shielding plate relatively smaller than the diameter of the light irradiating portion, the output determination error of the light receiving portion can be reduced. In FIG. 6A, for example, the diameter of the light irradiating portion and the width of the light shielding plate are 0.6 L to 2 L, and in FIG. 6C, it is 1.8 L to 2 L. On the other hand, in FIG. 6E, the width of the light shielding plate is made smaller than the light beam diameter of the light irradiating portion such as L to 1.8 L (2 L to 3.6 L). An attitude change distance at this time is 1.3 L+Δ in FIG. 6A, while it is 0.9 L+Δ for the light shielding plate in FIG. 6E, and an effect to reduce the determination error by the attitude change of the light shielding plate by 0.4 L can be obtained.

Moreover, in the present invention, by configuring such that mounting positions of the light shielding plates 15 and 16 are made different for each cartridge and by setting the output setting of the light receiving amount to at least 30% of the light receiving amount, the ink residual-amount detection of the ink cartridges adjacent to each other can be performed by the pair of light irradiating portion and light receiving portion and thus, it has an effect that the number of components is reduced. At that time, by configuring such that the light shielding plate of the ink cartridge to be determined for the light receiving amount of at least 30% is not subjected to the influence of the vertical fluctuation Δ of the ink liquid level, it has an effect that priority in the optical determination error is kept by using the light shielding plate equally divided in the perpendicular direction to the light beam.

Embodiment of the present invention has been described, but the present invention is not limited to the aforementioned Embodiment, but design changes can be made only in the description in the claims.

Embodiment 2

When a two-piece photodiode is used for the optical detecting portion in Embodiment 1, the residual amount of which ink in the ink cartridges adjacent to each other in the pair of light irradiating portion and light receiving portion is being detected can be identified. The two-piece photodiode is for obtaining an output by calculating a light receiving amount difference on the light receiving surface divided into two parts. The light receiving portion in FIG. 2 is changed to a two-piece photodiode having a light receiving region divided into two parts in accordance with the two light shielding plates 15 and 16, and the received light corresponding to the light beam shielded by the light shielding plates 15 and 16 is received by the light receiving surface divided into right and left parts.

In FIG. 5A, the light receiving amounts equally become 0% in both the right and left light receiving portions. In FIG. 5B, the light receiving amounts of right and left receiving portions are equal and the total light receiving amount is 100%, while the light receiving amount is 50% for each of them. In FIG. 5C, the light receiving amount is 0% in the left light receiving portion, and the total light receiving amount is 100% in the right and left, while the right light receiving amount is 50%. The light receiving amounts in the states of FIGS. 5D and 5E will be explained by referring to FIGS. 6E and 6F.

As illustrated in FIGS. 6E and 6F, when the ink cartridge 1 of the light shielding plate 15 is changing the attitude in the residual-amount detection state, the light shielding plate 16 crosses the light irradiating portion 7 laterally. In the two-piece photodiode, an increase/decrease of the light receiving amounts are reversed in the left light receiving amount and the right light receiving amount, and it is determined that there is no ink in the ink cartridge 1 when the light receiving amount is at least 30%. Since a signal of the output ON is displayed on the apparatus main body side, the ink cartridge in the displayed color is replaced with a new ink cartridge.

In addition, when the signs of the light shielding plates are opposite in the attitude change state in FIGS. 6E and 6F, that is, suppose that the light shielding plate 16 is used in the state in FIG. 6E, and the light shielding plate 15 is used in the state in FIG. 6F. The light shielding plate 15 crosses the light irradiating portion laterally, but since the light shielding plate 16 is out of the light beam region, 50% of the light is received at all times on the left light receiving surface. Thus, in the two-piece photodiode, when the left light receiving amount is 50%, and the right light receiving amount is increased/decreased within a range of 0 to 50%, it is determined that there is no ink in the ink cartridge 2.

According to the present Embodiment 2, there is an effect that determination by color of the ink residual amount in the ink cartridge can be made by using the two-piece photodiode for the light receiving portion of Embodiment 1.

Embodiment 3

Figure 8A:
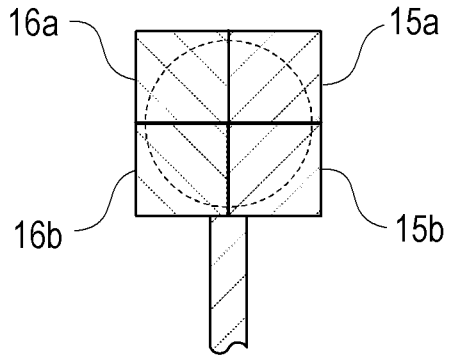
FIGS. 8A to 8C are explanatory views of the liquid residual-amount detecting devices according to Embodiments 3 and 4.
Figure 8B:
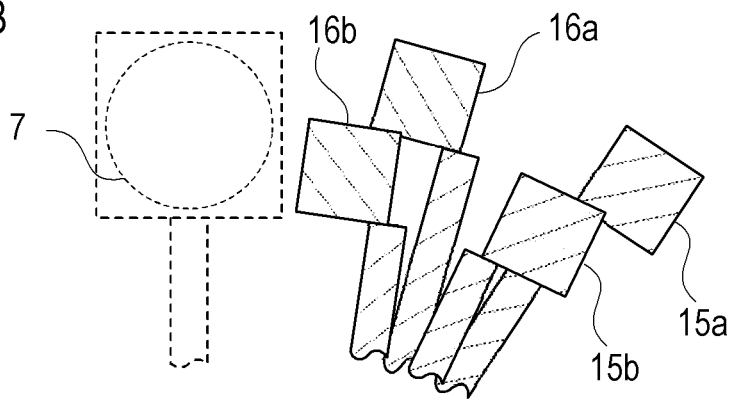

Embodiment 1 is to detect the two ink cartridges aligned in parallel by the pair of optical means, but the ink residual amount can be similarly detected by the pair of light irradiating portion and light receiving portion by aligning the four ink cartridges in parallel. However, with the two ink cartridges in parallel in Embodiment 1, the light shielding plate is equally divided in the perpendicular line direction with respect to the direction in which the float is rotationally moved to the light beam from the light irradiating portion, but in Embodiment 3, the light shielding plate divided into four parts by further adding equal division in a horizontal line direction is used. FIGS. 8A and 8B illustrate configuration examples of light shielding plates 15*a*, 15*b*, 16*a*, and 16*b*, which are divided into four parts. It is set such that the ink residual amount is detected when the light receiving amount of at least 15% is received by the light receiving portion as the predetermined light amount, and when the signal is displayed on the apparatus main body, the ink cartridge is visually recognized, and the cartridge with no ink is replaced with a new cartridge.

According to the present Embodiment 3, since the ink residual amounts of up to four ink cartridges can be detected by the pair of light irradiating portion and light receiving portion, there is an effect that the number of components is reduced.

Embodiment 4

Figure 8C:
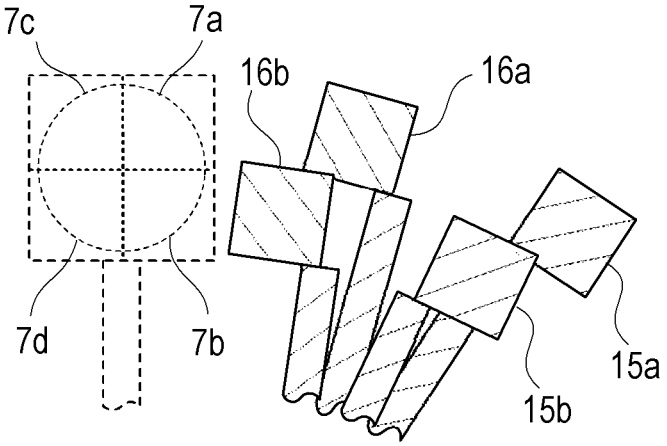

In Embodiment 2, the two-piece photodiode is used for the light receiving portion, but when the residual amounts of the four ink cartridges aligned in parallel in Embodiment 3 are detected by the pair of optical means, a four-piece photodiode is used for the light receiving portion. FIG. 8C illustrates a configuration example of the four-piece photodiode divided into four light receiving regions 7*a*, 7*b*, 7*c*, and 7*d* parts in accordance with the light shielding plates 15*a*, 15*b*, 16*a*, and 16*b*, which are divided into four parts. That is, regarding the four light receiving regions 7*a*, 7*b*, 7*c*, and 7*d*, two of them are disposed in the direction along the displacement path of the light shielding plate, while the other two in the direction orthogonal to the path. At that time, by setting the output setting of the light receiving portion to at least 15%, there is an effect that the ink residual amounts of the four ink cartridges aligned in parallel can be determined by color.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-165956, filed on Sep. 30, 2020, which is hereby incorporated by reference herein in its entirety.

What is claimed is:

1. A liquid residual-amount detecting device detecting a residual amount of a liquid contained in a liquid cartridge, the detecting device comprising:

an optical sensor having a pair of a light emitting portion and a light receiving portion; and a plurality of liquid cartridges each having a respective one of a plurality of light shielding portions, each of the plurality of liquid cartridges having a containing portion that contains the liquid, a float disposed in the containing portion and receiving buoyancy of the liquid, and a respective one of the plurality of light shielding portions which is displaced on a path that crosses an optical path of detection light emitted by the light emitting portion in synchronization with displacement of the float, wherein the plurality of light shielding portions each has a size such that a light amount of the detection light, which the light receiving portion receives, cannot be made smaller than a predetermined light amount by any of the light shielding portions acting alone, and wherein when the float is at a highest position in each of the plurality of liquid cartridges, the plurality of light shielding portions are disposed to be aligned in a direction crossing the optical path and shield the optical path, so that the light amount of the detection light, which the light receiving portion receives, is made smaller than the predetermined light amount.

2. The liquid residual-amount detecting device according to claim 1, wherein the predetermined light amount is a light amount which serves as a standard for determination on whether the residual amount of the liquid is less than a predetermined amount or not.

3. The liquid residual-amount detecting device according to claim 1, wherein a width of the light shielding portion in a direction along the path is larger than a half of a diameter of the light receiving portion and smaller than the diameter of the light receiving portion.

4. The liquid residual-amount detecting device according to claim 1, wherein the plurality of light shielding portions are disposed to be aligned in the direction along the path.

5. The liquid residual-amount detecting device according to claim 1, wherein the liquid residual-amount detecting device includes two of the liquid cartridges, and wherein the light receiving portion is a two-piece photodiode having light receiving regions obtained by being divided into two parts in accordance with two of the light shielding portions.

6. The liquid residual-amount detecting device according to claim 1, wherein the liquid residual-amount detecting device includes four of the liquid cartridges, and wherein in each of the four of the liquid cartridges, when four light shielding portions are disposed, two thereof are aligned in the direction along the path and the other two thereof are aligned in a direction orthogonal to the path in a case where the float is at the highest position.

7. The liquid residual-amount detecting device according to claim 6, wherein the light receiving portion is a four-piece photodiode having the light receiving region obtained by being divided into four parts in accordance with the four of the light shielding portions.

8. The liquid residual-amount detecting device according to claim 1, wherein the liquid cartridge has a detection window which transmits the detection light, wherein the light shielding portion is displaced in the detection window, wherein the plurality of liquid cartridges are disposed such that each of the detection windows thereof is aligned in a predetermined direction, and wherein the pair of the light emitting portion and the light receiving portion are disposed so as to sandwich the plurality of detection windows in the predetermined direction.

* * * * *